United States Patent [19]

Gasquet et al.

[11] Patent Number: 4,729,577

[45] **Date of Patent: * Mar. 8, 1988**

[54] LATCHING APPARATUS FOR A SKI BRAKE

[75] Inventors: Denis Gasquet, Annecy; Pierre Desarmaux, Metz-Tessy, both of France

[73] Assignee: Salomon S.A., Annecy, France

[ * ] Notice: The portion of the term of this patent subsequent to Jun. 30, 2004 has been disclaimed.

[21] Appl. No.: 946,012

[22] Filed: Dec. 24, 1986

Related U.S. Application Data

[63] Continuation of Ser. No. 581,726, Feb. 22, 1984, Pat. No. 4,676,520.

[30] Foreign Application Priority Data

Feb. 23, 1983 [FR] France ..... 83 03631

[51] Int. Cl.[4] ..... A63C 5/00

[52] U.S. Cl. ..... 280/605

[58] Field of Search ..... 280/614, 615, 604, 605

[56] References Cited

U.S. PATENT DOCUMENTS

| | | | |
|---|---|---|---|
| 3,924,864 | 12/1975 | Weigl | 280/113 |
| 4,350,364 | 9/1982 | Salomon | 280/605 |
| 4,352,506 | 10/1982 | Svoboda et al. | 280/605 |
| 4,463,967 | 8/1984 | Klubitschko | 280/605 |

FOREIGN PATENT DOCUMENTS

| | | |
|---|---|---|
| 2429719 | 1/1975 | Fed. Rep. of Germany . |
| 2502027 | 7/1975 | Fed. Rep. of Germany . |
| 2513188 | 10/1975 | Fed. Rep. of Germany . |
| 2502102 | 7/1976 | Fed. Rep. of Germany . |
| 2525945 | 12/1976 | Fed. Rep. of Germany . |
| 2652975 | 5/1978 | Fed. Rep. of Germany . |
| 364298 | 2/1981 | Fed. Rep. of Germany . |
| 8221957 | 10/1975 | France . |

*Primary Examiner*—John J. Love
*Assistant Examiner*—Richard Camby
*Attorney, Agent, or Firm*—Sandler & Greenblum

[57] ABSTRACT

Latching apparatus for a ski brake that has three elements: at least one braking element journalled on a base plate and movable between an active position, in which the braking element projects under the sole of the ski, and an inactive position, in which the braking element is raised with respect to the ski; an elastic system biasing the braking element toward the active position; and activation means for activating the braking element to move from the active to the inactive position in response to downward pressure from a boot on the activation means. The latching apparatus is a removable bar positioned either, between two of the movable elements of the brake or between the braking element and an element integral with the ski, to lock the braking element in its inactive position. The latching apparatus also includes an extension element, extending vertically above the bar, and positioned in front of the binding so as to block the insertion of the boot into the binding. In addition, the extension element is positioned between lateral edges of the ski above the sole of the ski so as to permit easy access to the sole of the ski and the edges of the ski for easy maintenance.

17 Claims, 7 Drawing Figures

LATCHING APPARATUS FOR A SKI BRAKE

This is a continuation of application Ser. No. 581,726, filed 2/24/84, issued U.S. Pat. No. 4,676,520 on 1/27/87.

BACKGROUND OF THE INVENTION

1. Field of the Invention

The present invention relates to a latching apparatus for a ski brake.

2. Description of Prior Art

Ski brakes have been increasingly mounted on skis in recent years to replace safety straps which suffered from well known disadvantages. Such ski brakes generally comprise one or more brake elements, sometimes known as "spades". These brake elements are adapted to implant themselves in the snow so as to immobilize the ski when the ski is separated from the boot of the skier as a result of a fall. Ski brakes generally also comprise an elastic mechanism which automatically moves the brake elements into an active brake position in which these brake elements project beneath the ski during a release of the binding. Such ski brakes further comprise a pedal connected to the brake elements and on which the boot of the ski is supported, during reinsertion of the boot, so as to pivot the brake elements into an inactive position which allows for skiing. In the inactive position, the brake elements are raised above the ski so as to prevent them from interfering with skiing.

The majority of presently available brakes satisfactorily accomplish their braking function, but unfortunately suffer from a number of disadvantages. For example, because the brake elements or spades are biased to project under the lower surface of the ski, these elements prevent maintenance of the ski and more particularly, the maintenance of the slide surface, which entails, for instance, the waxing and sharpening of the edges. In addition, when the brake is deployed in the braking position, the brake occupies a substantial volume. As a result, the ski occupies a substantial volume which elevates the cost of the packaging of the ski. In addition, this substantial volume requires the retail outlet that displays the ski to rent more floor space to accommodate the larger volume of the skis and their storage boxes. Because commercial and industrial rents are very high, this also increases the cost of these skis.

To overcome these disadvantages ski brakes have been proposed which comprises at least one braking element journalled on a base plate and movable between a first, active position in which it projects beneath the ski and a second, inactive position in which it is lifted with respect to the lower plane of the ski. The braking element is moved from the first to the second position by the means of voluntary action of the skier on a pedal against the bias of an elastic system. This pedal, in the active position, projects above the ski and comprises a plurality of elements which are movble with respect to one another during movement from one position to the other. At least one of the movable elements is connected to the base plate and a movable latch is provided to block displacement of the other elements with respect to it.

For example, German Application No. A-2,502,102 discloses a device in which a pivotable element or rocker, mounted on the ski, prevents the brake from moving into the active position as long as the skier does not put on the ski. Once the boot is inserted onto the ski, the rocker retracts to free the brake which is no longer maintained in an inactive position other than by pressure of the boot of the skier who must then put on the ski in a rapid movement without any hesitation or interruption.

In the apparatus described in Austrian Pat. No. 364,298, the brake can be latched in the inactive position by a movable stirrup comprising an element preventing insertion of the boot in the latched position. This stirrup can be displaced only by hand. Besides its complexity, the apparatus is relatively cumbersome and extends considerably beyond the lateral edges of the ski. This is disadvantageous because when this ski is transported there is a risk that the stirrup will catch and hook onto other materials. In addition, this protruding stirrup renders the sharpening of the edges of the ski corners particularly difficult.

Another latch for a ski brake is described in German Application No. A-2,429,719. Besides its considerable complexity and vulnerability to snow and freezing by virtue of the numerous rotating and sliding elements, this ski does not prevent insertion of the boot in the latched position.

For obvious reasons of safety, standards provide (e.g., DIN 7885-6.1.5) that the brake can be latched or placed out of operation to allow the ski to be worked upon, on the condition that this shut-down is the result of a well defined and characterized manipulation and cannot occur other than by means of a special tool. Furthermore, the latching apparatus, when it is in an active position, must necessarily prevent all insertion of the boot onto the ski.

German Application No. A-2,652,975 discloses a type of spring clip, which is adapted to be attached to the ski. In addition, it aids in the transportation and storage of the ski by surrounding the ski, and at the same time prevents the brake from moving into an active position. This apparatus is difficult to maneuver and resting on the lower surface of the ski, prevents all work on the edges of the ski and on the sole. It thus does not satisfy to the needs of the skier.

Finally, French Application No. 82 21 957 discloses a particularly simple apparatus which allows for the latching of the brake so as to allow for maintenance work, but it does not render insertion of the boot impossible in the latched position.

SUMMARY OF THE INVENTION

The present invention overcomes the insufficiencies of the prior art with respect to the standards referred to above by providing an apparatus of extremely simple design which does not interfere with the maintenance work that should be done on the edges and the sole of the ski.

In one embodiment, the invention is an apparatus for a ski brake. The brake is adapted to move from an inactive to an active position. In the active position, the brake brakes the ski after the release of the boot from the binding of the ski. In this type of ski, the boot passes through a zone above the ski when inserted into the binding. The apparatus comprises a latch adapted to be attached to the ski brake and means for preventing insertion of the boot into the binding. This means is attached to the latch and permits substantially free access to the edges of the ski. This means may comprise an extension element, adapted to extend into this zone when the latch is attached to the brake.

The latch may be removable from the ski brake and the extension element may extend substantially vertically upward above the ski. In addition, the extension is adapted to extend into the zone when the latch is attached to the brake, and the extension may be positioned between the lateral edges of the ski so as to permit substantially free access to the edges of the ski for the maintenance thereof. In addition, the extension element may be integral with the latch. In one embodiment, the extension element comprises a means for extending into the above-mentioned zone only when the brake is in the inactive position.

In addition, the extension element extends substantially perpendicular to the latch, and the latch is removable from the brake. In one embodiment, the latch may comprise an inverted substantially T-shaped bar. Alternatively, the latch may comprise a manipulation element adapted to be manipulated by the skier to remove the latch from the brake. In this embodiment, the extension comprises this manipulation element.

In another embodiment, the longitudinal axis of the latch means extends substantially parallel to the longitudinal axis of the brake when the brake is in the inactive position.

In still another embodiment, the ski comprises a sole, and the brake comprises three elements. The first element comprises at least one braking element journalled on a base plate and movable between the active and inactive position. In the active position, the braking element projects under the sole of the ski. In the inactive position, the braking element is raised with respect to the sole of the ski. In addition, the brake also comprises an elastic means for biasing the braking element toward the active position. Finally, the brake also comprises an activation means for activating the braking element to move from the active to the inactive position in response to the boot acting on the activation means against the bias of the elastic means. In addition, the activation means is adapted to be positioned in an active position above the ski. The brake, therefore, comprises at least two movable elements. In such a brake, the latch may comprise a removable bar positioned between the two movable elements to maintain the braking element in the inactive position.

In an alternative embodiment, the ski comprises an element integral therewith, and comprises the elements noted above in the previous embodiment. In such an embodiment, the latch comprises a removable bar positioned between the braking element and the element integral with the ski so as to maintain the braking element in the inactive position. In addition, the bottom of the apparatus of the present invention may be positioned above the sole of the ski so as to permit easy maintenance of the sole of the ski.

In still another embodiment, the invention comprises a latching apparatus for a ski brake. In this embodiment, the ski has lateral edges, and the ski brake brakes the ski after release of the boot from the binding of the ski. The brake is adapted to move between an active and an inactive position. In such a ski brake, the latching apparatus comprises locking means for locking the brake in the inactive position, and blocking means for blocking insertion of the boot into the binding. The latching apparatus is positioned between the lateral edges of the ski. In addition, the blocking means may be positioned in front of the binding.

In addition, when the boot is inserted into the binding, it passes through a zone above the ski. The blocking means is positioned in this zone so as to block the insertion of the boot into the binding.

In one embodiment, the blocking means is attached to the locking means, and the locking means is removable from the brake. In addition, the blocking means may comprise a bar substantially perpendicular to the longitudinal axis of the locking means. Alternatively, the latching apparatus may comprise an inverted, substantially T-shaped bar. In addition, the bottom of the apparatus in this embodiment is positioned above the sole of the ski so as to provide for easy maintenance thereof.

In this embodiment of the latching apparatus that comprises a blocking means, the apparatus may be used with the ski brake discussed above that comprises the at least one braking element journalled on a base plate, the elastic means, and the activation means. In this embodiment, the locking means comprises a removable bar positioned between two movable elements of the brake to maintain the braking element in the inactive position.

In still another embodiment, the invention comprises an apparatus for a ski brake which brakes a ski after release of the boot from a binding on the ski. The brake is adapted to move from an active to an inactive position, and the ski comprises edges. In the apparatus used with this type of ski brake and ski, the apparatus comprises latching means for latching the brake in the inactive position; and means for preventing the insertion of the boot into the binding when the boot is in the inactive position. The apparatus is adapted to permit substantially free access to the edges of the ski so that the edges can be easily maintained. The insertion prevention means may be attached to the latching means, and may comprise an element positioned in front of the binding to block the entry of the boot into the binding. This element may be positioned between the lateral edges of the ski. In addition, the bottom of the apparatus may be positioned above the sole of the ski, and the apparatus itself may be removable from the brake.

Insertion prevention means may also comprise a bar, extending substantially vertically above the ski when the latching means latches the binding in the inactive position. Alternatively, the apparatus of the present invention may comprise an inverted, substantially T-shaped bar.

This apparatus, comprising the latching means and the insertion prevention means may be used with the ski brakes discussed above. More specifically, the latching means may be positioned between two movable elements of the ski brake or between an element integral with the ski and the braking element to prevent relative movement therebetween and to maintain the braking element in the inactive position. The latching means may comprise a removable bar.

BRIEF DESCRIPTION OF THE DRAWINGS

The invention will now be described with reference to a plurality of embodiments in the detailed description that follows with reference to the attached drawings given by way of non-limiting example only, in which.

DETAILED DESCRIPTION OF PREFERRED EMBODIMENTS

Figure 1:
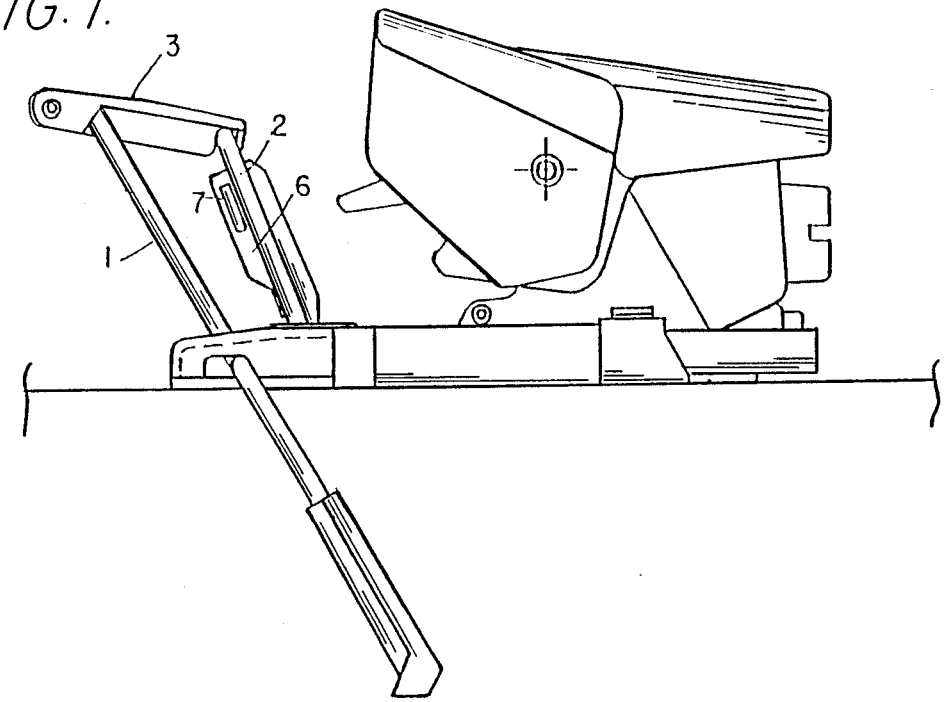
FIGS. 1 and 2 illustrate a side view of a first embodiment of the invention, in which a known brake is shown is in the active position in FIG. 1 and in the latched position in FIG. 2.

The various brake constructions generally encountered are well known to those of ordinary skill in the art and will not be described in any detail in this application because they are well known, and because the invention is not limited to any one particular brake.

Referring to FIGS. 1–4, a braking apparatus is illustrated, which is connected to a rear binding. The binding is illustrated in a general fashion but without reference numerals. This braking apparatus, which is described in French Application No. 82 21 957, the disclosure of which is herein incorporated by reference, and which is well known, comprises a braking stirrup 1, journalled on a base plate. Stirrup 1 is biased towards its active position shown in FIG. 1 by an elastic system 2 connected to stirrup 1 by an activating element 3. The pressure of the boot on activating element 3 causes the braking apparatus to move from the active braking position (shown in FIG. 1) to the inactive position (shown in FIG. 2, in which the boot is illustrated, and FIG. 3). During this movement, the three elements 1, 2, 3 are movable with respect to one another. In the inactive position the sharpening of the edges and the maintenance of the sole of the ski can be performed if the braking apparatus is latched or locked in this inactive position.

Figure 2:
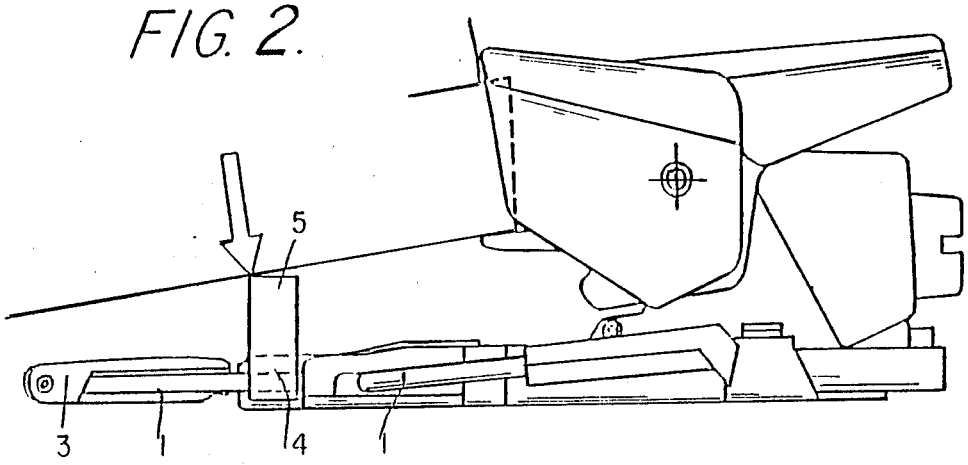
Figure 3:
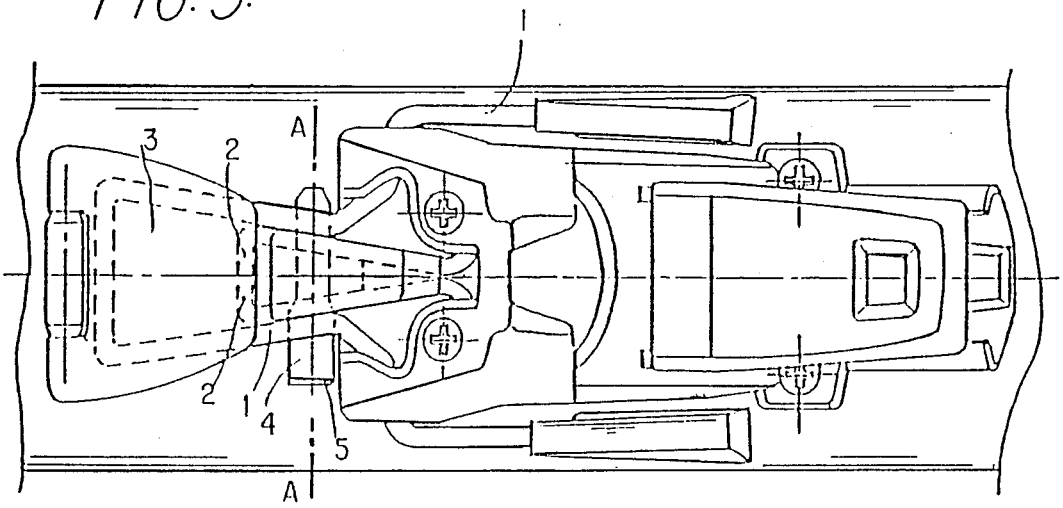
FIG. 3 is a top view of the embodiment shown in FIGS. 1 and 2.
Figure 4:
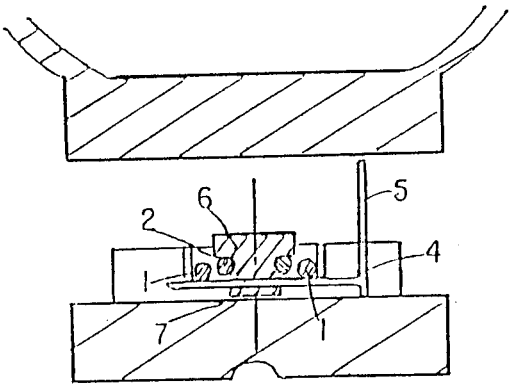
FIG. 4 is a partial cross-sectional view along line AA of FIG. 3.

To latch or lock the brake in the inactive position, a known removable bar or lock or latch 4 is provided. Latch 4 comprises a tool, separate from the brake itself. Latch 4 prevents the movement of two of the three elements 1, 2, and 3 with respect to one another. For example, as shown in FIGS. 1–3, element 2 of the elastic system is blocked from movement with respect to stirrup 1. To accomplish this, element 2 is connected to a projecting element 6 having a transverse slot 7. Once the apparatus has been placed in the inactive position, bar 4 is introduced into this slot 7 under the arms of stirrup 1 and prevents any displacement of movable elements 1 and 2 with respect to each other, and thus, bar 4 prevents the movement of the braking assembly into the active braking position.

In the prior art brakes, bar 4 as positioned, does not prevent insertion of the boot. According to the present invention, on the other hand, an extension 5 is provided which is shown particularly in FIGS. 2 and 4. The longitudinal axis of extension 5 is preferably substantially perpendicular to the longitudinal axis of bar 4. In addition, extension 5 is sufficiently long to project into a zone which is necessarily swept by the boot when the boot is inserted into the binding on the ski, and thus renders insertion of the boot impossible. In addition, latch 4 and extension 5 do not extend beyond the lateral edges of the ski and are spaced from the sole of the ski so that they permit substantially free access to the lateral edges and the sole of the ski. In addition, this blocking of insertion of the boot into the binding occurs even though the elasticity of the rear binding normally allows for insertion of the boot when a layer of snow is present on the base plate or under the sole of the boot.

Although latch 4 and extension 5 form one integral element in this embodiment, it is within the scope of the invention to separate the two functions of latch 4 an extension 5. Thus for example, there may be separate means for locking or latching the brake in the inactive position and for preventing or blocking insertion of the boot into the binding.

Figure 5:
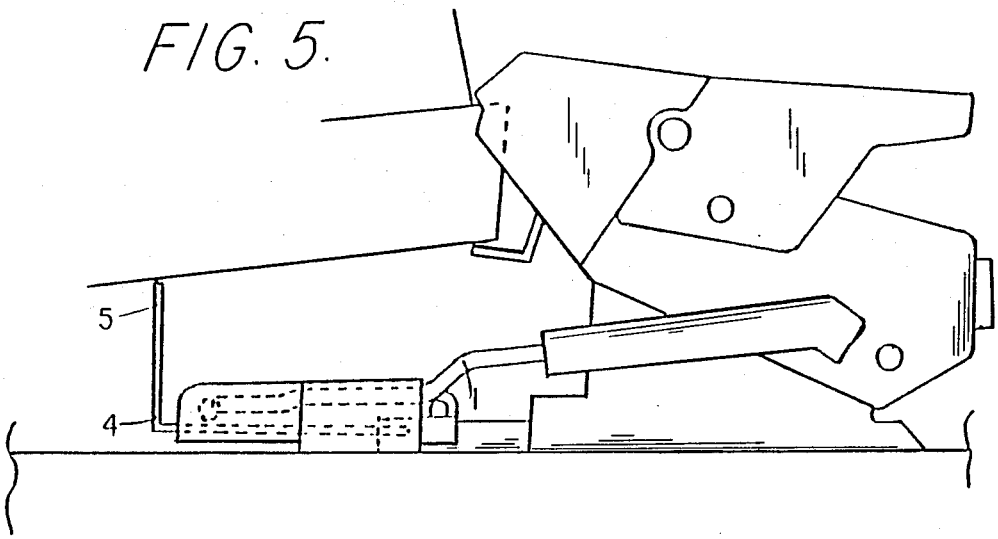
FIG. 5 illustrates a side view of another embodiment of the invention used with another known type of brake.

FIG. 5 illustrates the type of brake discussed in French Application No. 2,460,690, the disclosure of which is hereby incorporated by reference, and which need not be described in detail. The present invention, in this type of brake, comprises a bar tool or latch or lock 4, whose longitudinal axis is disposed substantially in the longitudinal direction from the front to the rear of the braking assembly in the inactive position, to block the movable elements from cooperating with the positioning of stirrup 1 into the active position. According to the invention, bar or latch 4 has an extension 5 which, is, for example, disposed substantially vertically and which, in this position, will project upwardly into a zone swept by the boot (illustrated in FIG. 5), when the boot is inserted into the binding, thereby rendering insertion of the boot into the binding impossible.

Figure 6:
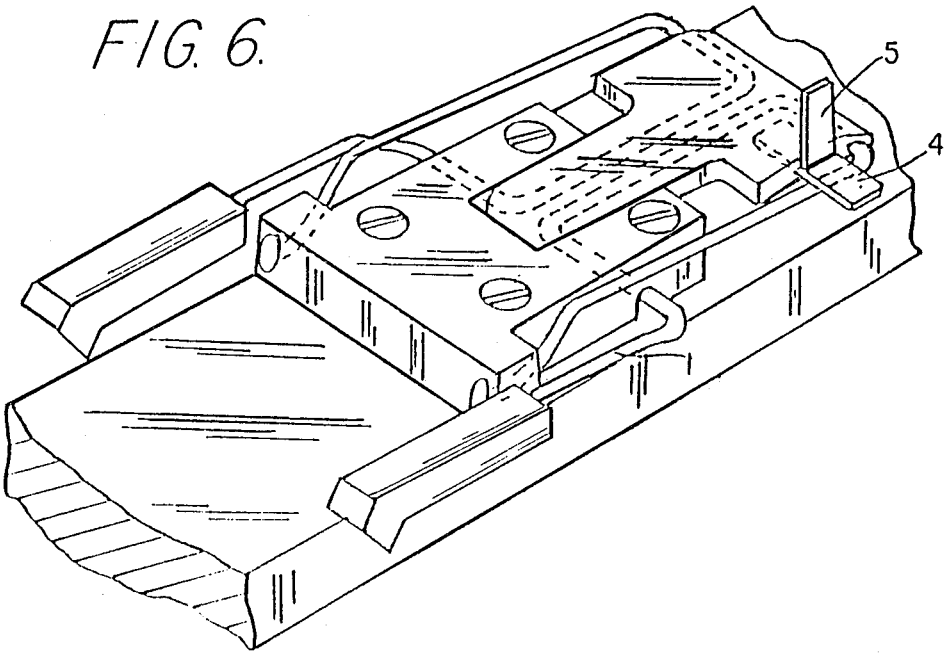
FIGS. 6 and 7 illustrate two additional applications of the invention to two additional types of known brakes.

FIG. 6 illustrates another embodiment of a bar or latch or lock 4 according to the invention. The braking apparatus in FIG. 6 is of the type which is known and described in French Application No. 2,451,751, which is hereby incorporated by reference. The manner by which this braking apparatus is latched is also known as well, and for further detail, one is referred to this document. According to the invention, known bar or latch 4 is replaced, with ample provision made for necessary constructional details, by an upside down or inverted T-shaped element whose median bar 5 projects upwardly, in order, as in the previous case, to create an obstacle in the zone which must necessarily be swept by the boot when the boot is inserted into the binding of the ski.

The insertion of the boot into the binding is impossible as long as bar 4 and 5 is in place.

Other applications of the present invention are also possible. They are a function of the type of braking apparatus utilized. For example, in all of known apparatus having a removable latch, the bar or latch must be positioned manually by the skier to block, either a movable element with respect to the base plate or another element integral with the ski. The bar or latch is these known apparatus always has a portion serving as a manipulation means which is to be manipulated by the skier to move the bar or latch. The manipulation means or element is positioned exterior to the assembly of elements of the braking apparatus when the bar is in place, to block the movement of the appropriate elements referred to above. This manipulation means can be configured in a manner such that it comprises an extension which extends into the zone which the boot must sweep during its insertion of the binding. This can be done regardless of the type of braking apparatus.

Figure 7:
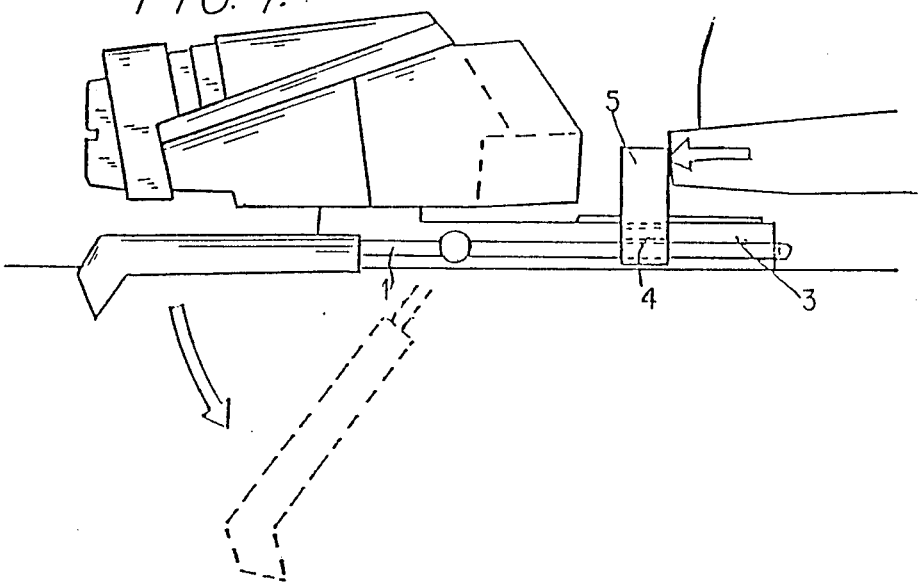

FIG. 7 illustrates an alternative embodiment in which the bar or latching tool or lock comprises an extension arranged in the trajectory of the boot and prevents the longitudinal displacement of the front of the boot which is necessary for introduction of the boot into the front binding. In this embodiment, the brake is positioned at the front abutment and not at the rear abutment, as in the previous embodiments.

Although the invention has been described with reference to particular means, materials and embodiments, it is to be understood that the invention is not limited to the particulars disclosed and extends to all equivalents within the scope of the claims.

What is claimed is:

1. An apparatus for a ski brake in combination with said ski brake, wherein said brake comprises: at least two elements forming a toggle, wherein said elements are adapted to be displaced with respect to each other so as to move from an inactive position to an active position in which said brake brakes a ski having edges thereon after release of a boot from a binding on the ski, and wherein said apparatus comprises:

(a) a latch adapted to be attached to said ski brake to prevent relative displacement between said at least two elements in said inactive position so as to latch said brake in the inactive position; and (b) means for preventing insertion of said boot in said binding, wherein said means is attached to said latch, wherein said boot passes through a zone above said ski when normally inserted into said binding and wherein said means comprises an extension element adapted to extend into said zone when attached to said brake, wherein said extension element is spaced in the longitudinal direction of the ski a distance from said binding.

2. The apparatus defined by claim 1 wherein said latch is removable from said ski brake.

3. The apparatus defined by claim 1 wherein said means comprises an extension element extending substantially vertically upward above said ski, and wherein said latch is positioned between the lateral edges of said ski.

4. The binding defined by claim 1 wherein the bottom of said apparatus is positioned above the sole of said ski.

5. The apparatus defined by claim 1 wherein said element comprises means for extending into said zone only when said brake is in said inactive position.

6. The apparatus defined by claim 1 wherein said apparatus is adapted to permit substantially free access to the edge of said ski, and wherein said extension element is integral with said latch.

7. The apparatus defined by claim 1 wherein said extension element extends substantially perpendicular to said latch.

8. The apparatus defined by claim 7 wherein said latch is removable from said brake.

9. The apparatus defined by claim 8 wherein said latch comprises an inverted substantially T-shaped bar.

10. The apparatus defined by claim 8 wherein said latch comprises a manipulation element adapted to be manipulated by the skier to remove said latch from said brake, wherein said extension comprises said manipulation element.

11. The apparatus defined by claim 6 wherein the longitudinal axis of said latch extends substantially parallel to the longitudinal axis of said brake in said inactive position.

12. The apparatus defined by claim 6 wherein said ski comprises a sole and said brake comprises at least one braking element journalled on a base plate and movable between an active position in which said braking element projects under said sole of said ski, and an inactive position in which said braking element is raised with respect to said ski sole, and wherein said brake further comprises elastic means for biasing said braking element toward said active position and wherein said brake further comprises activation means for activating said braking element to move from said active to said inactive position in response to said boot acting on said activation means against the bias of said elastic means, wherein said activation means is adapted to be positioned in an active position above said ski, and wherein said brake comprises at least two movable elements and wherein sad latch further comprises:

a removable bar positioned between said two movable elements to maintain said braking element in said inactive position.

13. The apparatus defined by claim 6 wherein said ski comprises a sole and said brake comprises at least one braking element journalled on a base plate and movable between an active position in which said braking element projects under said sole of said ski, and an inactive position in which said braking element is raised with respect to said ski sole, and wherein said brake further comprises elastic means for biasing said braking element toward said active position and wherein said brake further comprises activation means for activating said braking element to move from said active to said inactive position in response to said boot acting on said activation means against the bias of said elastic means, wherein said ski comprises an element integral therewith, and wherein said latch further comprises:

a removable bar positioned between said braking element and said element integral with said ski to maintain said braking element in said inactive position.

14. The apparatus defined by claim 1 wherein said brake comprise first, second and third elements, wherein said first element is connected to said third element, wherein said second element connects said first and third elements, wherein said latch is adapted to be connected between said second and third elements to prevent relative displacement between said second and third elements.

15. The apparatus defined by claim 14 wherein said first element comprises a stirrup, wherein said second element comprises means for biasing said stirrup into said active position, wherein said third element comprises an activating element adapted to be displaced by said boot from said active position to said inactive position.

16. The apparatus defined by claim 15 wherein said activating element comprises a projection having a slot therein, wherein said slot is adapted to receive said latch therein.

17. The apparatus defined by claim 16 wherein in said inactive position of said brake said slot is positioned such that when said latch is positioned in said slot said latch is positioned under said stirrup.

* * * * *

UNITED STATES PATENT AND TRADEMARK OFFICE

CERTIFICATE OF CORRECTION

PATENT NO. : 4,729,577

DATED : March 8, 1988

INVENTOR(S) : Denis GASQUET et al.

It is certified that error appears in the above-identified patent and that said Letters Patent is hereby corrected as shown below:

At column 1, line 59, change "movble" to ---movable---.
At column 4, line 63, delete "is".
At column 5, line 68, change "an" to ---and---.
At column 6, line 44, change "is" to ---in---.

Signed and Sealed this

Twenty-fourth Day of January, 1989

*Attest:*

DONALD J. QUIGG

*Attesting Officer*

*Commissioner of Patents and Trademarks*